US008967986B2

(12) United States Patent
Harashima et al.

(10) Patent No.: US 8,967,986 B2
(45) Date of Patent: Mar. 3, 2015

(54) SCROLL FLUID MACHINE HAVING SEAL MEMBER WITH PLURAL LINEAR CUT ARRANGEMENT

(75) Inventors: Toshikazu Harashima, Tama (JP); Yoshiyuki Kanemoto, Samukawa (JP); Koji Fukui, Machida (JP); Susumu Sakamoto, Kawasaki (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 556 days.

(21) Appl. No.: 12/813,854

(22) Filed: Jun. 11, 2010

(65) Prior Publication Data

US 2011/0070116 A1 Mar. 24, 2011

(30) Foreign Application Priority Data

Aug. 31, 2009 (JP) ..... 2009-199208

(51) Int. Cl.

| | |
|---|---|
| ***F04C 18/02*** | (2006.01) |
| ***F01C 19/00*** | (2006.01) |
| ***F04C 27/00*** | (2006.01) |

(52) U.S. Cl.

CPC ..... *F04C 18/0215* (2013.01); *F01C 19/005* (2013.01); *F04C 18/0284* (2013.01); *F04C 27/005* (2013.01)

USPC ..... 418/55.4; 418/55.2; 418/55.5; 277/357; 277/559

(58) Field of Classification Search

CPC ..... F04C 18/02; F04C 27/00; F01C 19/005; F01C 18/0215; F01C 18/0284; F01C 27/005

USPC ..... 418/55.4, 55.5, 55.2; 277/357, 559

See application file for complete search history.

(56) References Cited

U.S. PATENT DOCUMENTS

| | | | | |
|---|---|---|---|---|
| 4,564,343 | A * | 1/1986 | Nakamura et al. | 277/379 |
| 4,627,799 | A * | 12/1986 | Terauchi | 418/55.4 |
| 5,035,589 | A * | 7/1991 | Fraser et al. | 418/1 |
| 6,126,422 | A * | 10/2000 | Crum et al. | 418/55.4 |
| 6,604,923 | B2 * | 8/2003 | Rinella | 418/55.2 |
| 6,705,617 | B2 * | 3/2004 | Mellet et al. | 277/559 |
| 7,293,969 | B2 * | 11/2007 | Midorikawa | 418/55.4 |
| 7,775,528 | B2 * | 8/2010 | Berdichevsky | 277/559 |

FOREIGN PATENT DOCUMENTS

| | | |
|---|---|---|
| JP | 07-229485 | 8/1995 |
| JP | 07-229485 A | 8/1995 |

(Continued)

OTHER PUBLICATIONS

Muller, Heinz K. and Bernard S. Nau. Fluid Sealing Technology, Principles and Applicaitons. New York: Marcel Dekker, Inc., 1998. Ch. 6: Rotary Lip Seals, pp. 4-7; Figure 21, pp. 96.*

(Continued)

*Primary Examiner* — Mary A Davis
*Assistant Examiner* — Paul Thiede
(74) *Attorney, Agent, or Firm* — McDermott Will & Emery LLP

(57) ABSTRACT

To provide a higher sealing capability irrespective of the pressure difference between compression chambers, lips having leading ends extended toward the inner surface of a recessed groove are formed. At least some of the lips have a base end that is shaped to reduce rigidity against extension of the lips.

10 Claims, 9 Drawing Sheets

(56) References Cited

FOREIGN PATENT DOCUMENTS

| | | | |
|---|---|---|---|
| JP | 09-250466 | A | 9/1997 |
| JP | 10-047266 | | 2/1998 |
| JP | 2004-092480 | | 3/2004 |
| JP | 2004-092480 | A | 3/2004 |

OTHER PUBLICATIONS

English language machine-generated translation of JP 2004-092480 to Harashima.*

Office Action issued Feb. 5, 2013 in Japanese Patent Application No. 2009-199208.

Office Action dated Dec. 4, 2012 in Chinese Patent Application No. 201010248808.3.

* cited by examiner

SCROLL FLUID MACHINE HAVING SEAL MEMBER WITH PLURAL LINEAR CUT ARRANGEMENT

RELATED APPLICATION

This application claims the benefit of priority from Japanese Application No. JP-2009-199208 filed on Aug. 31, 2009 entitled "Scroll Fluid Machine," the disclosure of which also is entirely incorporated herein by reference.

TECHNICAL FIELD

The present subject matter relates to a scroll fluid machine that is suitable, for instance, for use with an air compressor, a refrigerant compressor, or a vacuum pump.

BACKGROUND

A scroll fluid machine described in JP-A No. 2004-92480 includes a lip that is formed by making a linear cut in the seal to prevent leakage into a recessed groove formed on a tooth top of a wrap for the bottom surface of a sealing member. When compressed air in a compression chamber enters the recessed groove, the sealing member rises in such a manner that its upper side surface slidingly contacts the tooth bottom land on the other side, and the leading end of the lip is pressed against the bottom surface of the recessed groove. Thus, an airtight seal is formed between the tooth bottom land and the wrap on the other side.

Another scroll fluid machine, which is described in JP-A No. H7-229485, includes a fin-shaped lip that is placed on the bottom surface of a sealing member and uniform in thickness. Still another scroll fluid machine, which is described in JP-A No. H10-47266, includes a lip that is formed by making a curved (arc-shaped) cut in the bottom and lateral surfaces of a sealing member.

SUMMARY

There is still a need to improve sealing, for example, to provide a higher sealing capability irrespective of the pressure difference between compression chambers even when the sealing member is worn.

According to one example, there is provided a scroll fluid machine including a first scroll and a second scroll. The first scroll includes a spirally wound wrap. The second scroll faces the first scroll and includes a spirally wound wrap in such a manner as to overlap with the wrap of the first scroll and form plural compression chambers. A recessed groove is extending along a tooth area of one of the wraps of the scrolls. A sealing member is mounted between the recessed groove and the tooth land of the scroll of the other scroll. Plural linear cuts are spaced apart along a direction of length of the sealing member made in a surface of the recessed groove to form plural lips having leading ends extended toward the inner surface of the recessed groove. At least some of the lips have a base end that is shaped to reduce rigidity against extension of the lips.

In another example, there is provided a scroll fluid machine including a first scroll, a second scroll, a sealing member, and lips.

The first scroll includes a spirally wound wrap. The second scroll faces the first scroll and includes a spirally wound wrap. The sealing member is mounted between the wrap of the first scroll and the tooth land of the second scroll. Lips each having an extended leading end formed by a linear cut, is inclined at an angle smaller than 90 degrees from a surface of sealing member facing the wrap of the first scroll of the sealing member. A base end of each of the lips is thinner than a base end of a lip formed merely by a single linear cut.

The examples make it possible to provide a scroll fluid machine having a sealing member that exhibits a higher sealing capability than a conventional sealing member without regard to the pressure difference between compression chambers.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

The drawing figures depict one or more implementations in accord with the present teachings, by way of example only, not by way of limitation. In the figures, like reference numerals refer to the same or similar elements.

Examples will be described in detail based on the following drawings, wherein.

DETAILED DESCRIPTION

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Reference now is made in detail to the examples illustrated in the accompanying drawings and discussed below.

Figure 1:
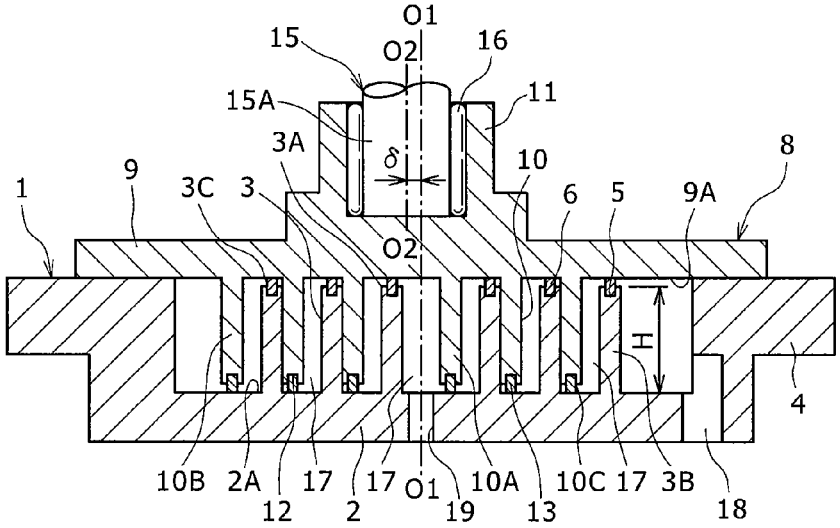
FIG. 1 is a vertical cross-sectional view of a scroll fluid machine.

A scroll fluid machine in a first example will now be described. Referring to FIG. 1, the reference sign 1 denotes a stationary scroll, which is a part of a casing of the scroll fluid machine. The stationary scroll 1 is fastened to an open end of a casing body (not shown), which is substantially shaped like a covered tube, in such a manner as to cover the open end. The stationary scroll 1 substantially includes a disc-shaped end plate 2, which is positioned in such a manner that its center coincides with the axis line O1-O1 of a later-described drive shaft 15. A spiral wrap 3 is placed on a tooth bottom land 2A (or a tooth land 2A) of the end plate 2; and a support 4 is positioned on the outward spiral part of the end plate 2 and shaped like a tube to surround the wrap 3.

The drawings show a particular orientation; and the description here uses a number of terms that have somewhat directional meanings, such as "bottom, "Top," "upper," and "vertically," which correspond to the illustrated orientation and the directional aspects of the descriptive terms are intended to be exemplary and helpful in understanding but not limiting.

Figure 2:
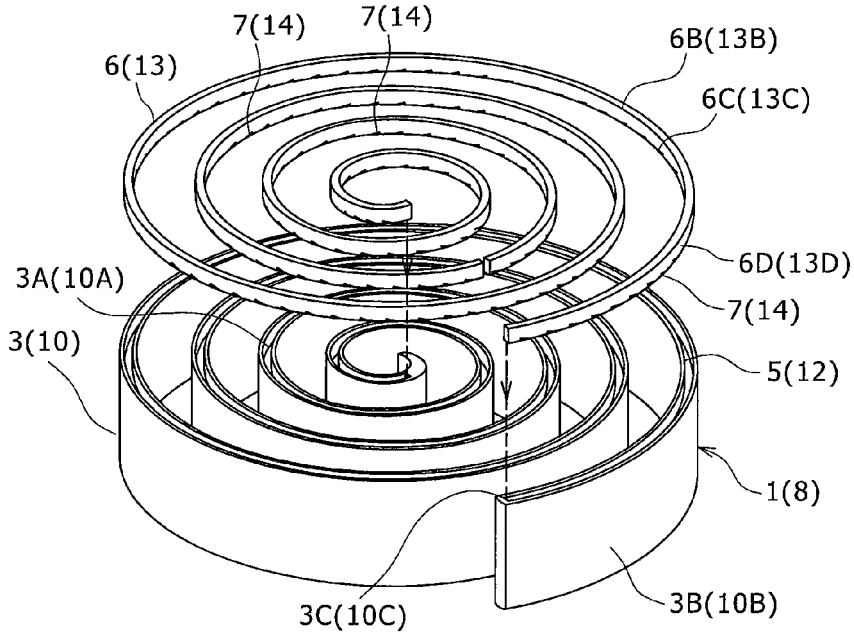
FIG. 2 is an exploded perspective view showing a wrap and a sealing member of a stationary scroll or a rotary scroll of the machine shown in FIG. 1.

As shown in FIG. 2, the wrap 3 of the stationary scroll 1 is configured so that winding begins with its inward spiral part and ends with its outward spiral part. For example, the wrap 3 is in a spiral form and divisible into former and latter portions made of three and a half turns. The wrap 3 includes an inward spiral part wrap 3A and an outward spiral part wrap 3B, which are disposed in the direction of spiraling. The outward spiral part wrap 3B corresponds to former and latter portions made of one and a half turns, which are positioned between the end of winding and the inward spiral part, is displaced outward from the inward spiral part 3A closer to the outer end of the sealing member 6, and has a predetermined height of H as measured from the tooth bottom land 2A of the end plate 2 as shown in FIG. 1. The inward spiral part wrap 3A, on the other hand, is formed in consideration of thermal expansion so that its height decreases gradually from the outward spiral part wrap 3B to the inward spiral part. Consequently, a relatively large clearance is provided between the inward spiral part wrap 3A and a later-described tooth bottom land 9A, which is on the other side.

Figure 4:
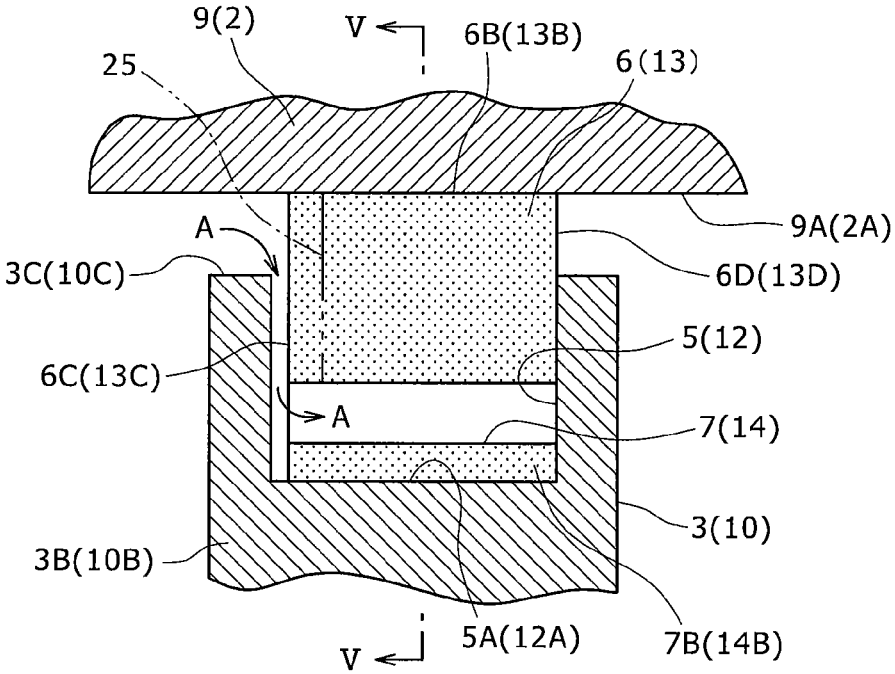
FIG. 4 is an enlarged view showing a state where the sealing member fits into a recessed groove has risen toward the tooth bottom land of a scroll on the other side.

The reference sign 5 denotes a recessed groove formed in a tooth top 3C (or tooth edge 3C) of the outward spiral part wrap 3B. As shown in FIG. 4, the recessed groove 5 is positioned in the middle of the width of the outward spiral part wrap 3B and formed in such a manner as to have a substantially U-shaped transverse cross-section. The inner surface 5A of the recessed groove 5 is extended along the spiral form of the outward spiral part wrap 3B to the end of winding. A later-described sealing member 6 is placed in the recessed groove 5 to seal a gap between the recessed groove 5 and the tooth bottom land 9A of a scroll on the other side.

The reference sign 6 denotes the sealing member, which is positioned between the tooth top 3C of the wrap 3 and the tooth bottom land 9A of the scroll on the other side and placed in the recessed groove 5 in the wrap 3. The sealing member 6 is made of an elastomeric resin material that excels in wear resistance and slidability, such as polytetrafluoroethylene (PTFE) or other fluorine resin, polyether sulfone (PES), polyphenylene sulfide (PPS), polyether ether ketone (PEEK), liquid crystal polymer (LCP), or polysulfone (PSF), formed as a long tip seal having a rectangular transverse cross section, and extended spirally along the longitudinal direction of the recessed groove 5.

As shown in FIG. 4, the sealing member 6 includes a lower side surface 6A, which is placed on the inner surface 5A of the recessed groove 5. An upper side surface 6B of the sealing member 6 is vertically opposite of the lower side surface 6A and slidingly faces and contacts the tooth bottom land 9A of the end plate 9 of the scroll on the other side. An inner side surface 6C is positioned on the radially inside of the spiral sealing member 6. An outer side surface 6D is positioned on the radially outside of the spiral sealing member 6. Later-described lips 7 are formed integrally with the lower side surface 6A. The inner and outer side surfaces 6C, 6D of the sealing member 6 are inserted into the recessed groove 5 with a small gap in between so that the lower side surface 6A is placed on the inner surface 5A of the recessed groove 5. Therefore, when the lips 7 are extended, the sealing member 6 can extend from the inner surface 5A of the recessed groove 5 toward the tooth bottom land 9A on the other side.

The lips 7 may alternatively be formed on the upper side surface 6B of the sealing member 6 instead of being formed on the lower side surface 6A. Another alternative is to form the lips 7 on the inner side surface 6C or the outer side surface 6D of the sealing member because it provides an enhanced radial sealing capability. Here, it should be noted that wear occurs on the upper side surface 6B of the sealing member 6 as described later. Therefore, if the sealing member's lower side surface 6A, which is opposite to the upper side surface 6B, is provided with the lips 7, the sealing capability of the sealing member 6 particularly becomes a problem. Consequently, the subsequent description deals with an example in which the lips 7 are formed on the lower side surface 6A.

As for an oil-free scroll fluid machine that is used particularly in a food or medical supply manufacturing plant or a semiconductor manufacturing process, it is necessary to obtain increased seal airtightness with the sealing member 6 because an oil seal cannot be provided between the sealing member 6 and the wrap 3.

Recently, there has been an increasing demand for scroll fluid machines to be highly pressurized and downsized. Thus, it is necessary to rotate a rotary scroll 8 at an increased speed. Consequently, the upper side surface 6B of the sealing member 6 is easily worn. When wear occurs on the upper side surface 6B of the sealing member 6, to form an airtight seal for compressed air, it is necessary to extend the lips 7 to an increased degree. The results of analyses have indicated that it is necessary to reduce the rigidity of a leading end 7B of the lips 7 when the pressure difference between compression chambers is small and reduce the rigidity of a base end 7A of the lips 7 when the pressure difference between the compression chambers is great.

When, for instance, a lip of the sealing member is formed by making a linear cut with a linear blade as described in JP-A No. 2004-92480 or by making a curved (arc-shaped) cut as described in JP-A No. H10-47266, the thickness of the lip gradually increases from the leading end to the base end. Therefore, the base end of the lip is more rigid than the leading end. When the base end of the lip has high rigidity, the lip base end does not deform; therefore, only the leading end deforms.

When the base end of the lip has high rigidity as described above, the lip does not extend in accordance with the wear of the sealing member. This inhibits the upper side surface of the lip from reaching the tooth bottom land of a scroll on the other side, thereby increasing the amount of leakage passing between the sealing member and the scroll on the other side. High pressure prevailing at the center is then applied to the outward spiral part through a passage between the sealing member and the scroll on the other side. It is therefore probable that the pushing pressure of the sealing member will increase to further increase the amount of sealing member wear.

When, on the other hand, the thickness of the lip is uniform from the leading end to the base end as described in JP-A No. H7-229485, the leading end is excessively rigid. Therefore, the lip may fail to rise when there is a small pressure difference between the front and back of the lip. Further, when the lip of the sealing member is formed by making a curved (arc-shaped) cut as described in JP-A No. H10-47266 with the curvature of the curved cut increased, the thickness of the lip increases to make the leading end excessively rigid. It is therefore probable that the lip will fail to extend when there is a small pressure difference between the front and back of the lip. If the lip fails to rise as described above, the upper side surface of the lip fails to reach the tooth bottom land of the scroll on the other side, thereby increasing the amount of leakage passing between the sealing member and the scroll on the other side.

Figure 3:
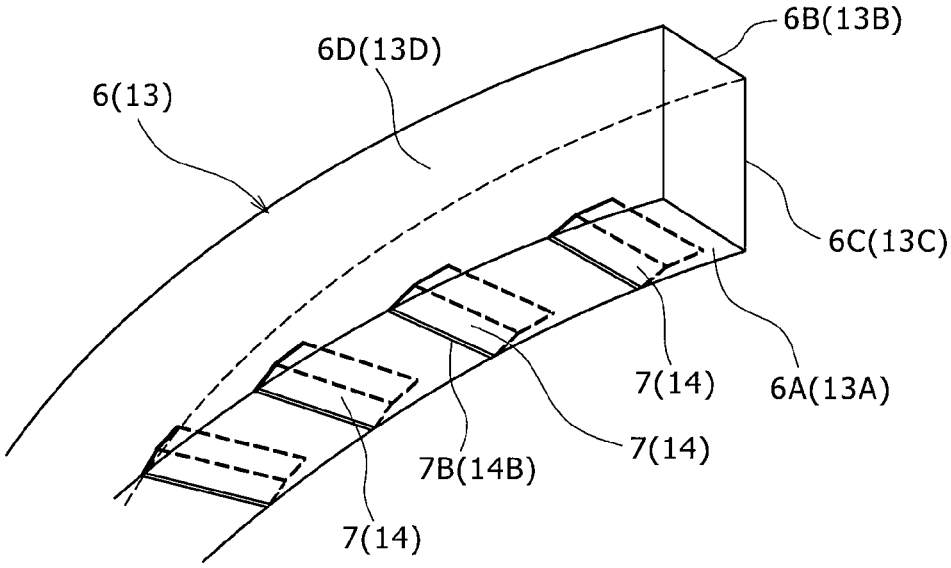
FIG. 3 is an enlarged perspective view of a part of the sealing member.
Figure 5:
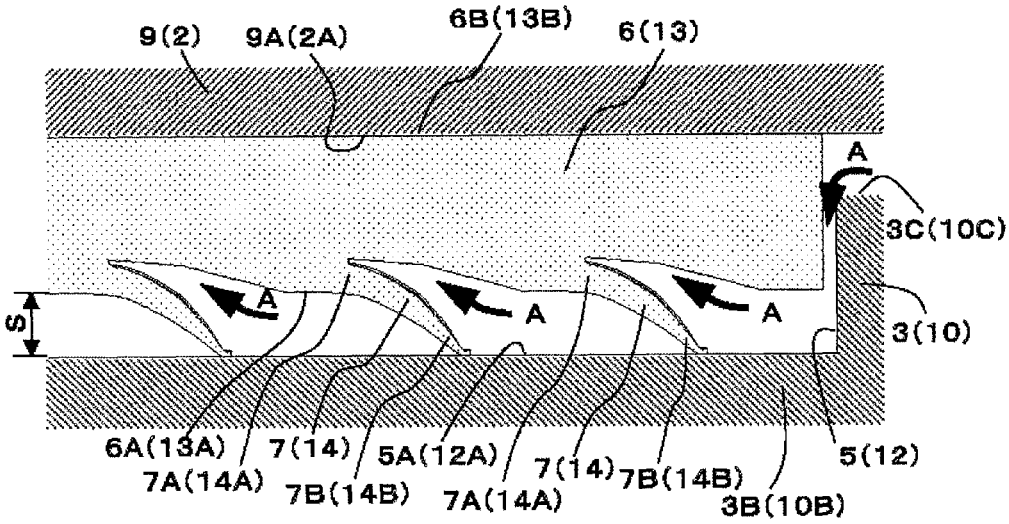
FIG. 5 is a cross-sectional view taken along the line V-V of FIG. 4.

To address the sealing member problem caused by the background technologies, the present example forms the lips 7 as described below. The reference sign 7 denotes the plural lips that are formed by making plural cuts in the sealing member 6. The lips 7 are disposed in the direction of the length of the sealing member 6 and positioned at predetermined spacing intervals. As shown in FIGS. 2 and 3, the individual lips 7 are formed by making a first linear cut and a second linear cut in the lower side surface 6A of the sealing member 6. The angle (cosine angle) formed by the first linear cut relative to the bottom surface is smaller than 90 degrees, and the angle (cosine angle) formed by the second linear cut relative to the bottom surface is smaller than the angle formed by the first linear cut. The thickness of each lip 7 increases from its leading end 7B to the base end 7A. Meanwhile, the thickness of the base end 7A is smaller than when the lips 7 are formed by making a deeper first cut instead of making a second cut. The base end 7A of each lip 7 is integral with the sealing member 6, whereas the leading end 7B is freed and spread from the sealing member 6 as shown in FIGS. 4 and 5. Thus, the lips 7 extend due to elastic deformation.

As a result, when compressed air in a later-described compression chamber 17 flows in the direction indicated by arrows A and enters the recessed groove 5 as shown in FIGS. 4 and 5 during an operation of the scroll fluid machine, the resulting pressure causes the upper side surface 6B of the sealing member 6 to slidingly contact the tooth bottom land 9A on the other side and rise. Further, the leading end 7B of each lip 7 is pressed against the inner surface 5A of the recessed groove 5 to form an airtight seal between the tooth bottom land 9A on the other side and the wrap 3. Consequently, each lip 7 fills a gap S between the inner surface 5A of the recessed groove 5 and the lower side surface 6A of the sealing member 6.

The reference sign 8 denotes the rotary scroll, which faces the stationary scroll 1 and is rotatably mounted in the casing body. The rotary scroll 8 includes an end plate 9, a wrap 10, and a boss 11. The end plate 9 is shaped like a disc, and its front surface is the tooth bottom land 9A. The wrap 10 is extended from the tooth bottom land 9A of the end plate 9 toward the end plate 2 of the stationary scroll 1 and spiral in shape as is the case with the wrap 3 of the stationary scroll 1. The boss 11 is positioned at the rear center of the end plate 9 and rotatably mounted on a crank 15A of a later-described drive shaft 15.

The wrap 10 of the rotary scroll 8 is configured so that winding begins with its inward spiral part and ends with its outward spiral part, as indicated in FIG. 2. For example, the wrap 10 is in a spiral form and divisible into former and latter portions made of three and a half turns. As is the case with the wrap 3 of the stationary scroll 1, the wrap 10 includes an inward spiral part wrap 10A and an outward spiral part wrap 10B, which are disposed in the direction of spiraling. The tooth top 10C of the outward spiral part wrap 10B is provided with a recessed groove 12 that is spirally extended to have a U-shaped transverse cross-section as is the case with the outward spiral part wrap 3B of the stationary scroll 1.

The reference sign 13 denotes another sealing member that is placed in the recessed groove 12 and capable of extending toward the tooth bottom land 2A on the other side. The sealing member 13 is formed in the same manner as the earlier-described sealing member 6 for the stationary scroll 1. More specifically, the sealing member 13 includes a lower side surface 13A, which is placed on the inner surface 12A of the recessed groove 12. An upper side surface 13B is vertically opposite to the lower side surface 13A and slidingly faces and contacts the tooth bottom land 2A on the other side. An inner side surface is positioned on the radially inside of the spiral sealing member 13. An outer side surface 13D is positioned on the radially outside of the spiral sealing member 13. The reference sign 14 denotes plural lips that are formed by making plural cuts in the sealing member 13. The lips 14 are disposed in the direction of the length of the sealing member 13 and positioned at predetermined spacing intervals. As is the case with the sealing member 6, the individual lips 14 are formed by making a first linear cut and a second linear cut in the lower side surface 13A of the sealing member 13. The angle (cosine angle) formed by the second linear cut relative to the bottom surface is smaller than the angle formed by the first linear cut. The thickness of each lip 14 increases from its leading end 14B to the base end 14A. The thickness of the base end 14A is smaller than when the lips 14 are formed by making the first cut only.

When the compressed air in the compression chamber 17 enters the recessed groove 12 during a compression operation, the resulting pressure causes the upper side surface 13B of the sealing member 13 to slidingly contact the tooth bottom land 2A for the stationary scroll 1 and rise. Further, the leading end 14B of each lip 14 is pressed against the inner surface 12A of the recessed groove 12 to form an airtight seal between the tooth bottom land 2A on the other side and the wrap 10. Consequently, each lip 14 fills a gap S between the inner surface 12A of the recessed groove 12 and the lower side surface 13A of the sealing member 13.

The reference sign 15 denotes a drive shaft, which is rotatably mounted in the casing body. A leading end of the drive shaft 15 is a crank 15A that is extended into the casing body. The axis line O2-O2 of the crank 15A is eccentric from the axis line O1-O1 of the drive shaft 15 by a predetermined value of δ. The boss 11 of the rotary scroll 8 is swingably mounted on the crank 15A of the drive shaft 15 through a slewing bearing 16. A swinging motion is given to the rotary scroll 8 through a rotation prevention mechanism (not shown) or the like.

The wrap 10 of the rotary scroll 8 is positioned to overlap the wrap 3 of the stationary scroll 1 in such a manner that the former is circumferentially displaced from the latter by a predetermined angle. Thus, crescent-shaped plural compression chambers 17 are formed between the wraps 3, 10. When the rotary scroll 8 swings relative to the stationary scroll 1, the volume of each compression chamber 17 continuously decreases to compress air taken in from a later-described suction port 18.

The reference signs 18, 19 respectively denote a suction port and a discharge port, which are formed in the stationary scroll 1. The suction port 18 is drilled in the outward spiral part of the end plate 2 to communicate with the outermost compression chamber 17. The discharge port 19 is drilled in the center of the end plate 2 to communicate with the innermost compression chamber 17.

When a motor or other driving source (not shown) rotationally drives the base end of the drive shaft 15 from the outside of the casing while the sealing member 6 (13) is placed in the recessed groove 5 (12) of the wrap 3 (10), the resulting rotary motion is transmitted from the crank 15A of the drive shaft 15 to the rotary scroll 8 through the slewing bearing 16. Thus, the rotary scroll 8 swings with a radius of the predetermined value of δ around the axis line O1-O1 of the drive shaft 15.

The plural compression chambers 17 formed between the wrap 3 of the stationary scroll 1 and the wrap 10 of the rotary scroll 8 is continuously reduced in size by the swinging motion of the rotary scroll 8. Therefore, air taken in from the suction port 18 is sequentially compressed in each compression chamber 17. The compressed air is then discharged from the discharge port 19 toward an external air tank (not shown) or the like.

In the above instance, part of the compressed air is introduced from each compression chamber 17 into a gap between the sealing member 6 (13) and the recessed groove 5 (12) formed in the tooth top 3C (10C) of the wrap 3 (10) as indicated by arrows A in FIGS. 4 and 5. The pressure of the compressed air is then exerted on the lower side surface 6A (13A) of the sealing member 6 (13). Thus, the sealing member 6 (13) is pressed toward the tooth bottom land 9A (2A) on the other side. In addition, the leading end 7B (14B) of each lip 7 (14) is pressed against the inner surface 5A (12A) of the recessed groove 5 (12).

As a result, the sealing member 6 (13) extends in the recessed groove 5 (12) to form a floating seal in such a manner that the upper side surface 6B (13B) slidingly contacts the tooth bottom land 9A (2A) on the other side. In addition, each lip 7 (14) fills the gap S between the inner surface 5A (12A) of the recessed groove 5 (12) and the lower side surface 6A (13A) of the sealing member 6 (13). Consequently, an airtight seal is formed between the neighboring compression chambers 17 through the wraps 3 (10).

Figure 7:
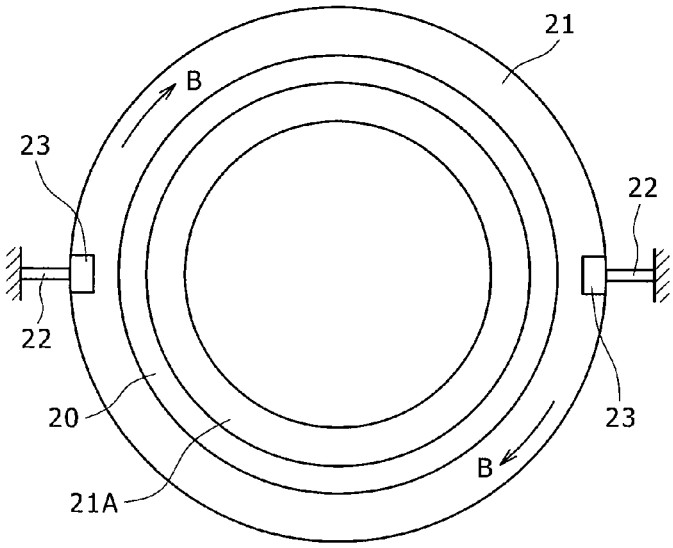
FIG. 7 is a plan view showing, for instance, a sealing body, a turntable, and cutters.
Figure 8:
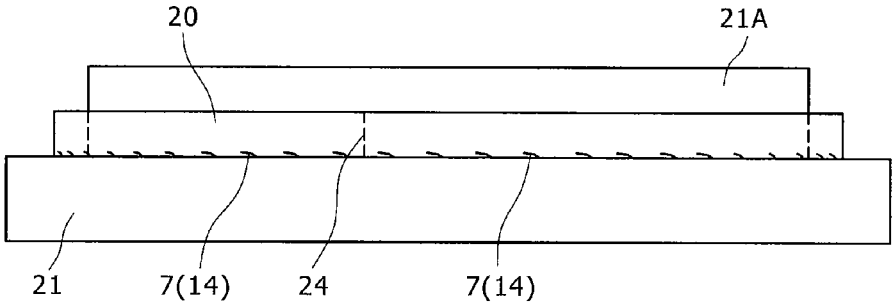
FIG. 8 is a front view of the sealing body and the turntable shown in FIG. 7.

A typical method of manufacturing the sealing member 6 (13) will now be described with reference to FIGS. 6 to 8.

Figure 6:
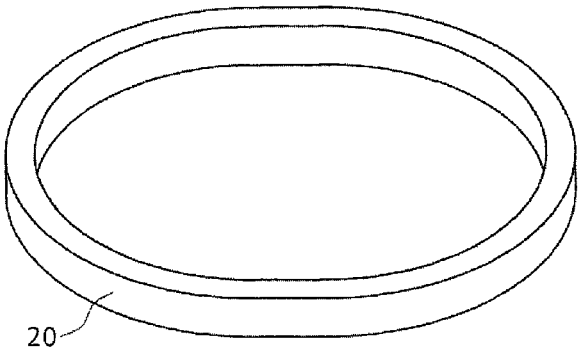
FIG. 6 is a perspective view of a ring-shaped sealing body that is used as a material for the sealing member.

First of all, a molding process is performed with an injection molding machine (not show) or the like to obtain a ring-shaped sealing body 20, which is used as a material for the sealing member 6 (13) as shown in FIG. 6, from an elastomeric resin material such as polytetrafluoroethylene (PTFE) or other fluorine resin, polyether sulfone (PES), polyphenylene sulfide (PPS), polyether ether ketone (PEEK), liquid crystal polymer (LCP), or polysulfone (PSF).

Next, a positioning process is performed. In this process, the ring-shaped sealing body 20 is properly positioned on a turntable 21, which is used as a support platform as shown in FIGS. 7 and 8. In this instance, the turntable 21 is formed as a projecting circular table, and the sealing body 20 is securely fit into the outward spiral part of a circular projection 21A. A pair of linear actuators 22, 22 is positioned to diametrically face each other and disposed on the radially outside of the turntable 21. A cutter 23 having a linear blade is removably mounted on the leading end of each actuator 22.

Next, a lip formation process is performed. In this process, the actuators 22 linearly move the cutters 23 forward or backward relative to the sealing body 20 as shown in FIG. 8 on the turntable 21 to make cuts in the sealing body 20 while the turntable 21 is rotationally driven in an intermittent manner at a fixed pitch in the direction of arrows B in FIG. 7. Further, while the turntable 21 rotates approximately 180 degrees in the direction of arrows B in FIG. 7, the cutters 23 repeat their cutting operations to sequentially form the plural lips 7 (14) on the sealing body 20 so as to circumferentially arrange the lips 7 (14) at predetermined spacing intervals.

Next, a cutting process is performed. This process is performed after the lips 7 (14) are formed along the entire circumference of the sealing body 20 as described above to cut the sealing body 20 along a cutting surface 24 indicated by a two-dot chain line in FIG. 8. This forms the sealing member 6 (13) that is spirally extended in a longitudinal direction as shown in FIG. 2. The cutting process may be performed on the turntable 21 or performed after the sealing body 20 is removed from the turntable 21.

Figure 18:
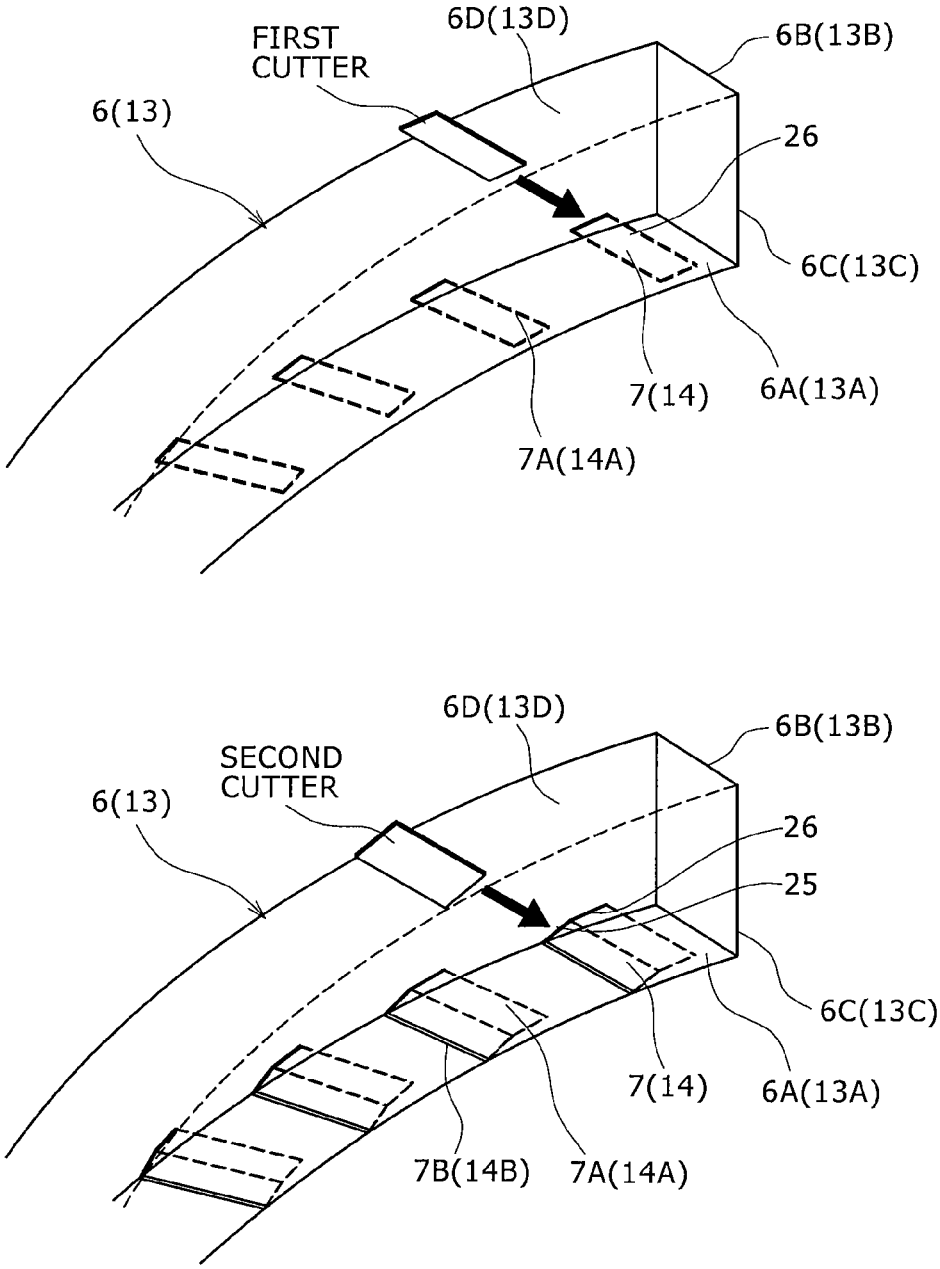
FIG. 18 is a diagram illustrating a method of making cuts in the sealing member according to the first example.

FIG. 18 illustrates in detail a method of forming the lips 7 (14) in accordance with the present example. First of all, a first cutter is inserted from a lateral surface 6D (13D) of the sealing member 6 (13) to form a later-described second cut 26. Next, a second cutter, which differs from the first cutter in length, is inserted at an angle different from the insertion angle of the first cutter from the lateral surface 6D (13D) of the sealing member 6 (13) to form a later-described first cut 25.

Figure 9:
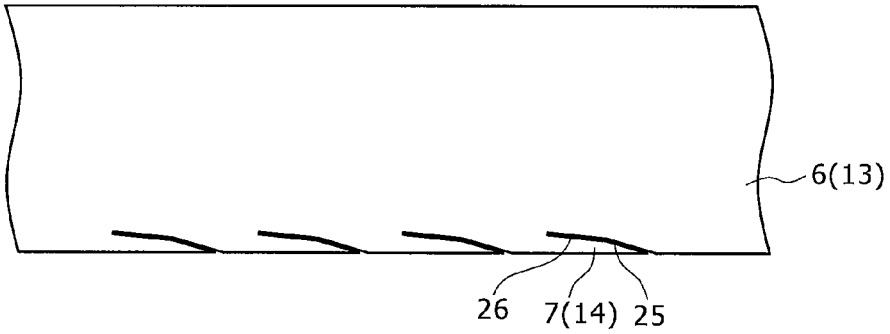
FIG. 9 is a diagram illustrating cuts made in the sealing member according to the first example.

FIG. 9 shows the shapes of the cuts that are made for the lips 7 (14) of the sealing member 6 (13) in accordance with the present example. The first cut 25, which is linear in shape and inclined at an angle (cosine angle) of smaller than 90 degrees from the bottom surface, is first made. Then, the second cut 26, which is linear in shape and inclined at an angle (cosine angle) smaller than the inclination angle (cosine angle) of the first cut from the bottom surface, is made to form a shape that reduces the rigidity of the base end 7A (14A) against the rise. The resulting shape is such that the thickness increases from the leading end 7B (14B) to the base end 7A (14A), and that the thickness of the base end 7A (14A) is smaller than when the lips 7 (14) are formed by making the first cut 25 only. In general, the rigidity of the lips 7 (14) decreases with a decrease in the thickness of the lips 7 (14). As far as the same pressure is applied to the lips 7 (14), the lips 7 (14) rise to a higher position as the thickness of the lips 7 (14) decreases. Therefore, forming the above-described shape makes it possible to reduce the rigidity of the leading end 7B (14B) of the lips 7 (14) and also reduce the rigidity of the base end 7A (14A) to a level lower than when the lips 7 (14) are formed by making the first cut 25 only. In other words, as the leading end 7B (14B) of the lips 7 (14) is thinned, the lips 7 (14) can readily rise even when the pressure difference between the compression chambers is small. Further, as the employed shape is such that the thickness of the base end 7A (14A) is smaller than when the lips 7 (14) are formed by making the first cut 25 only, the rigidity of the base end 7A (14A) is decreased to a level lower than when the lips 7 (14) are formed by making the first cut 25 only. This makes it possible to raise the lips 7 (14) to a high position. Consequently, airtightness between the compression chambers 17 can be maintained even when the sealing member 6 (13) is worn.

Figure 13:
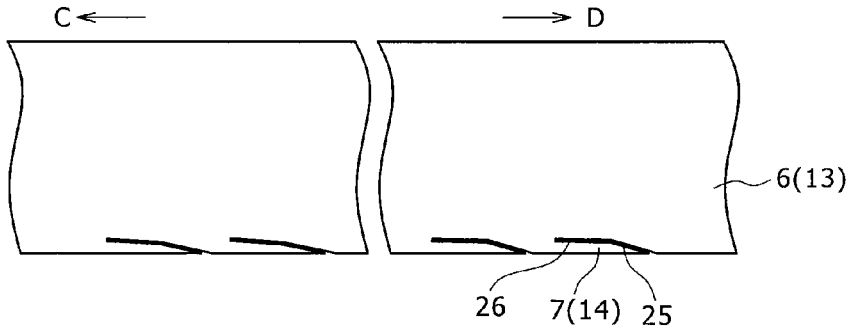
FIG. 13 is a diagram illustrating cuts made in the sealing member according to a modification of the first example.

The angle (cosine angle) between the bottom surface and the first cut 25 is set, for instance, to 10 to 20 degrees, and the angle (cosine angle) between the bottom surface and the second cut 26 is set to be smaller than the angle (cosine angle) between the bottom surface and the first cut 25. If the cutting angles are excessively large, the lips 7 (14) become excessively thick. This makes it difficult for the lips 7 (14) to rise. If, on the contrary, the cutting angles are excessively small, processing becomes difficult because the lips 7 (14) may readily come off from the sealing member 6 (13) during processing. In view of the above circumstances, the cutting angles are set as described above. Alternatively, the angle (cosine angle) between the bottom surface and the second cut 26 may be 0 degree (the second cut 26 may be parallel to the bottom surface), or may be negative as indicated in FIG. 13, which will be referenced later, that is, the second cut 26 may approach the bottom surface as its depth increases.

The interval between two cuts (between the first cuts 25) needs to be determined in consideration of the following factors. If the two cuts overlap with each other, the lips 7 (14) may readily come off during processing, thereby making it difficult to achieve processing. It is therefore necessary to ensure that the two cuts do not overlap with each other. However, if the interval between the two cuts is too short, the lips 7 (14) become shorter. If, in this instance, the sealing member 6 (13) is worn, it cannot fill the gap S between the inner surface 5A (12A) of the recessed groove 5 (12) and the lower side surface 6A (13A) of the sealing member 6 (13). If, on the contrary, the interval between the two cuts is too long, the number of lips 7 (14) per unit length decreases. Therefore, if the lips 7 (14) fail to extend for some reason, the quality of a seal formed between neighboring compression chambers 17 is significantly degraded. Consequently, the interval between the two cuts needs to be set in such a manner that the length of each lip 7 (14) and the number of lips 7 (14) per unit length are both sufficient. In view of the considerations outlined above, the present example is configured so that the interval between the two cuts is, for example, 2 mm to 5 mm. The present example is also configured so that the distance between the base end 7A (14A) and leading end 7B (14B) of the lips 7 (14) is shorter than the interval between the two cuts by 0.5 mm to 1.5 mm.

Referring again to FIG. 9, the first cut 25 and the second cut 26, which are both linear, are made as described above. However, the shapes of the cuts are not limited to linear. The first cut 25 or the second cut 26 may alternatively be shaped like a curve (arc) as far as the employed curve (arc) has a small curvature and can be approximated to a straight line. More specifically, as far as the base end 7A (14A) is thinner than when only the first cut is made for formation purposes, an alternative is to make a first curved (arc-shaped) cut 25 and then make a second curved (arc-shaped) cut 26 in such a manner that the angle (cosine angle) between the bottom surface and the second cut 26 is smaller than the angle (cosine angle) between the bottom surface and the first cut 25. Another alternative is such that either the first cut 25 or the second cut 26 is shaped like a curve (arc). Obviously, the cuts made in accordance with later-described examples (second to fifth examples) may also be shaped like a curve (arc).

Referring again to FIG. 9, the angles (cosine angles) between the bottom surface and the first and second cuts for the lips 7 (14) formed on the inward spiral part of the sealing member 6 (13) are the same as the angles (cosine angles) between the bottom surface and the first and second cuts for the lips 7 (14) formed on the outward spiral part of the sealing member 6 (13). Alternatively, however, the above angles may differ from each other in consideration of the fact that the pressure applied from the compression chambers 17 is relatively high at the center of the spiral sealing member 6 (13) and relatively low on the outward spiral part of the spiral sealing member 6 (13).

Here, it should be noted that the inward spiral part of the sealing member 6 (13) is likely to wear because the compression chambers 17 apply a relatively high pressure to it. When the sealing member 6 (13) is worn, the rigidity of the base end 7A (14A), in particular, needs to be decreased in order to raise the base end 7A (14A) as well. Accordingly, as shown in FIG. 13, the angle (cosine angle) between the bottom surface and the second cut 26 for a first lip 7 (14), which is formed on the inward spiral part (positioned toward direction D) and will significantly wear, may be set to be smaller than the angle (cosine angle) between the bottom surface and the second cut 26 for a second lip 7 (14), which is positioned on the outward spiral part of the first lip 7 (14) (toward direction C). This makes it possible to increase the useful life of the sealing member because the base end 7A (14A) of the first lip 7 (14), which is positioned on the inward spiral part, rises high even when the sealing member 6 (13) is worn.

Meanwhile, as for the second lip 7 (14), which is formed on the outward spiral part of the sealing member 6 (13), the sealing member 6 (13) does not significantly wear. However, as the compression chambers 17 apply a low pressure to the second lip 7 (14), the leading end, in particular, needs to be extended at the low pressure. Therefore, as shown in FIG. 13, the angle (cosine angle) between the bottom surface and the first cut 25 for the second lip 7 (14), which is formed on the outward spiral side (positioned toward direction C), may be set to be smaller than the angle (cosine angle) between the bottom surface and the first cut 25 for the first lip 7 (14), which is positioned on the inward spiral part (toward direction D). This makes the leading end 7B (14B) of the lips 7 (14) thinner. Therefore, even when the applied pressure is low, the lips 7 (14) extend to improve the airtightness of the sealing member 6 (13).

Further, a two-step cut may be made, as described in connection with the present example, for the first lip 7 (14), which is formed on the inward spiral part of the sealing member 6 (13) and significantly wears, and a one-step cut may be made for the second lip 7 (14), which is formed on the outward spiral part of the sealing member 6 (13) and does not significantly wear, for instance, by making the first cut 25 only to provide increased ease of processing.

Figure 10:
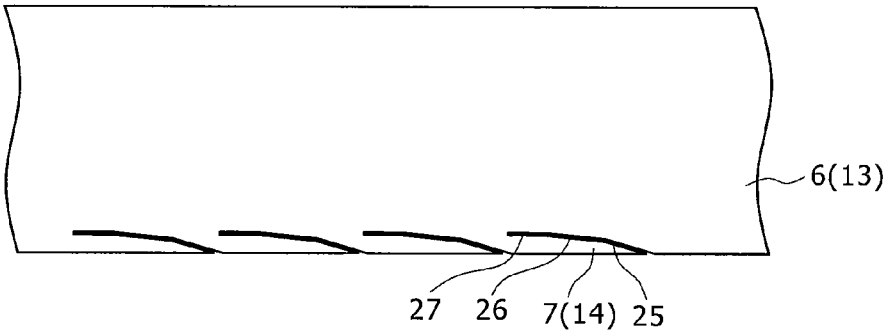
FIG. 10 is a diagram illustrating cuts made in the sealing member according to a second example.

A second example will now be described. FIG. 10 shows the shapes of cuts for the lips 7 (14) of the sealing member 6 (13) according to the second example. In the description of the second example, elements identical with those of the first example are designated by the same reference signs as the corresponding elements and will be omitted from the description. The form of the second example is shaped to reduce the rigidity of the base end 7A (14A) against the rise by making a first cut 25, which is linear in shape and inclined at an angle (cosine angle) of smaller than 90 degrees from the bottom surface, making a second cut 26, which is linear in shape and inclined at an angle (cosine angle) smaller than the inclination angle (cosine angle) of the first cut 25 from the bottom surface, and making a third cut 27, which is linear in shape and inclined at an angle (cosine angle) smaller than the inclination angle (cosine angle) of the second cut 26 from the bottom surface. In the present example, the angle (cosine angle) between the bottom surface and the first cut 25 is set, for instance, to 15 to 20 degrees, the angle (cosine angle) between the bottom surface and the second cut 26 is set to be smaller than the angle (cosine angle) between the bottom surface and the first cut 25, and the angle (cosine angle) between the bottom surface and the third cut 27 is set to be smaller than the angle (cosine angle) between the bottom surface and the second cut 26. The angle (cosine angle) between the bottom surface and the second cut 26 or the third cut 27 may be 0 degree (the second cut 26 or the third cut 27 may be parallel to the bottom surface), or may be negative, that is, the second cut 26 or the third cut 27 may approach the bottom surface as its depth increases. Making a three-step cut as described above ensures that the base end 7A (14A) of the lips 7 (14) is thinner than in the first example. Consequently, the rigidity of the base end 7A (14A) against the rise can be further reduced.

The present example assumes that a cutting operation is performed in three steps. Alternatively, however, the cutting operation may be performed in four steps or in five steps. However, if the cutting operation is performed in an excessive number of steps, it is necessary to increase the spacing intervals between the lips 7 (14) or the angle (cosine angle) between the bottom surface and the first cut 25 for the purpose of preventing the lips 7 (14) from coming off during processing. It is therefore preferred that the cutting operation be performed in five or fewer steps.

Referring again to FIG. 10, the cutting operation for the first lip 7 (14), which is formed on the inward spiral part of the sealing member 6 (13), is performed in the same number of steps as for the second lip 7 (14), which is displaced outward from the first lip 7 (14) and formed on the outward spiral part of the sealing member 6 (13). Alternatively, however, the first and second lips 7 (14) may differ in the number of cutting steps. For example, the cutting operation for the first lip 7 (14), which is formed on the inward spiral part, may be performed in a larger number of steps than for the second lip 7 (14), which is formed on the outward spiral part. When the number of cutting steps is increased for the inward spiral part, where the sealing member significantly wears, it is possible to decrease the thickness of the base end 7A (14A) of the lips 7 (14). Therefore, the useful life of the sealing member 6 (13) can be increased because the lips 7 (14) rise high even when the sealing member 6 (13) is worn. Further, decreasing the number of cutting steps for the second lip 7 (14), which is formed on the outward spiral part, where the pressure applied from the compression chambers 17 is low, makes it possible to reduce the angle (cosine angle) between the bottom surface and the first cut 25. This decreases the thickness of the leading end 7B (14B) of the lips 7 (14). Consequently, the airtightness of the sealing member 6 (13) improves because the lips 7 (14) rise even when the applied pressure is low. An alternative is to perform multiple cutting steps for the first lip 7 (14), which is formed on the inward spiral part of the sealing member 6 (13), and perform a single cutting step for the second lip 7 (14), which is formed on the outward spiral part of the sealing member 6 (13), in order to provide increased ease of processing.

A third example will now be described. This example is one of examples illustrating spatial grooves 28. The lip 7 (14) of the sealing member 6 (13) is provided by spatial grooves 28 formed at base ends 7A (14A) for reducing the rigidity again the extension of the lips 7 (14).

Figure 11:
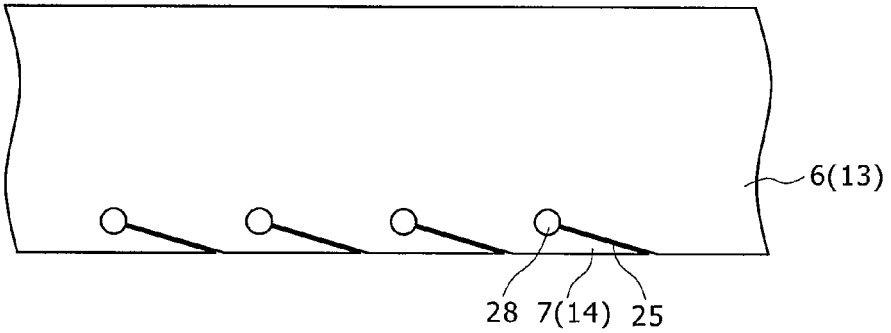
FIG. 11 is a diagram illustrating cuts and spatial grooves made in the sealing member according to a third example.

FIG. 11 shows the shapes of the lips 7 (14) of the sealing member 6 (13) according to the third example. In the description of the third example, elements identical with those of the first or second example are designated by the same reference signs as the corresponding elements and will be omitted from the description. In the third example, a linear cut 25 is made in such a manner that the angle (cosine angle) between the cut 25 and the bottom surface is smaller than 90 degrees. Further, a spatial groove 28 is at intersections of surfaces of the cut 25 and the lip 7 (14). Forming the spatial groove 28 ensures that the rigidity of the base end 7A (14A) against the rise of the lips 7 (14) is lower than in the case of the lips 7 (14) according to the first example. The third example assumes that the spatial groove 28 is circular in shape. However, the shape of the spatial groove 28 is not limited to circular. The spatial groove 28 may alternatively be oval or polygonal in shape as far as the base end 7A (14A) of the lips 7 (14) is thinner than when only the linear cut 25 is made for the lips 7 (14).

The rigidity of the base end 7A (14A) of the lips 7 (14) decreases with an increase in the size of the spatial groove 28. However, if the spatial groove 28 is excessively large in size, the lips 7 (14) may readily come off from the sealing member 6 (13) during processing, thereby making it difficult to achieve processing. Therefore, the size of the spatial groove 28 needs to be determined in consideration of the above.

Figure 14:
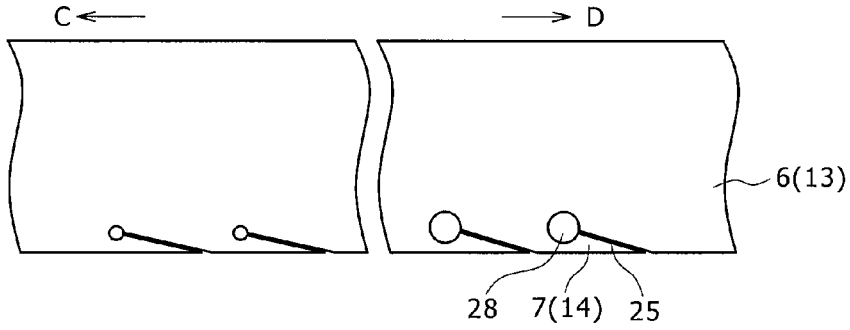
FIG. 14 is a diagram illustrating cuts and spatial grooves made in the sealing member according to a modification of the third example.

Referring to FIG. 11, the size of the spatial groove 28 for the first lip 7 (14), which is formed on the inward spiral part of the sealing member 6 (13), is the same as the size of the spatial groove 28 for the second lip 7 (14), which is displaced outward from the first lip 7 (14) and formed on the outward spiral part of the sealing member 6 (13). Alternatively, however, the first and second lips 7 (14) may differ in the size of the spatial groove 28. For example, as shown in FIG. 14, the size of the spatial groove 28 for the first lip 7 (14), which is formed on the inward spiral part of the sealing member 6 (13) (positioned toward direction D), may be larger than the size of the spatial groove 28 for the second lip 7 (14), which is formed on the outward spiral part of the sealing member 6 (13) (positioned toward direction C). When the size of the spatial groove 28 is increased for the inward spiral part (positioned toward direction D), where the sealing member 6 (13) significantly wears, the thickness of the base end 7A (14A) of the lips 7 (14) decreases. Consequently, the rigidity of the base end 7A (14A) of the lips 7 (14) decreases so that the lips 7 (14) rise high even when the sealing member 6 (13) is worn. This will increase the useful life of the sealing member 6 (13).

Further, the first lip 7 (14), which is formed on the inward spiral part of the sealing member 6 (13) (positioned toward direction D), and the second lip 7 (14), which is formed on the outward spiral part of the sealing member 6 (13) (positioned toward direction C), may differ not only in the size of the spatial groove 28 but also in the angle (cosine angle) between the bottom surface and the cut 25. For example, the angle (cosine angle) between the bottom surface and the cut 25 for the second lip 7 (14), which is formed on the outward spiral part of the sealing member 6 (13) (positioned toward direction C), may be set to be smaller than the angle (cosine angle) between the bottom surface and the cut 25 for the first lip 7 (14), which is formed on the inward spiral part of the sealing member 6 (13) (positioned toward direction D). When the angle (cosine angle) between the bottom surface and the cut 25 for the lips 7 (14) formed on the outward spiral part of the sealing member 6 (13) is decreased as described above, the thickness of the leading end 7B (14B) of the lips 7 (14) decreases. This enables the lips 7 (14) to rise even when the applied pressure is low. Consequently, the airtightness of the sealing member 6 (13) improves.

Meanwhile, the angle (cosine angle) between the bottom surface and the cut 25 for the first lip 7 (14), which is formed on the inward spiral part of the sealing member 6 (13) (positioned toward direction D), is larger than the angle (cosine angle) between the bottom surface and the cut 25 for the second lip 7 (14), which is formed on the outward spiral part of the sealing member 6 (13) (positioned toward direction C). This increases the rigidity of the base end 7A (14A) of the lips 7 (14). In this respect, increasing the size of the spatial groove 28 for the first lip 7 (14), which is formed on the inward spiral part of the sealing member 6 (13), makes it possible to reduce the rigidity of the base end 7A of the first lip (14) by decreasing the thickness of the base end 7A (14A). This poses no problem because the lips 7 (14) can rise high even when the sealing member 6 (13) is worn.

Figure 16:
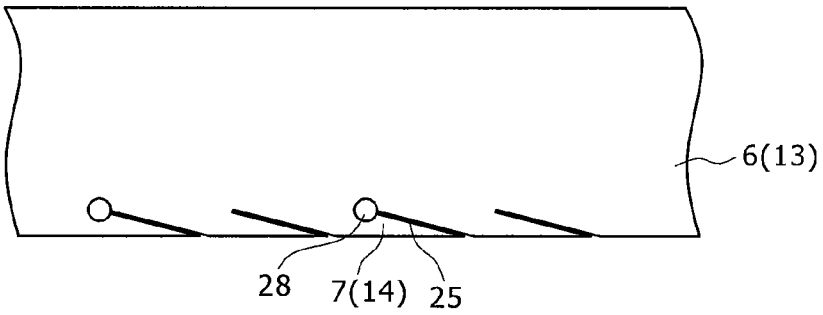
FIG. 16 is a diagram illustrating cuts and spatial grooves made in the sealing member according to a modification of the third example.

The spatial groove 28 need not always be formed for all lips 7 (14). It may alternatively be formed for some of the lips 7 (14) in order to provide increased ease of processing. For example, the spatial groove 28 may be formed for every other lip as shown in FIG. 16. Another alternative is to form the spatial groove 28 for the first lip 7 (14), which wears significantly and is formed on the inward spiral part of the sealing member 6 (13) (positioned toward direction D), as described in connection with the present example, and form no spatial groove 28 for the second lip 7 (14), which does not wear significantly and is formed on the outward spiral part of the sealing member 6 (13) (positioned toward direction C). More specifically, the second lip 7 (14), which is disposed on the outward spiral part of the sealing member 6 (13) (positioned toward direction C), may be formed merely by making the cut 25 while providing the first lip 7 (14), which is formed on the inward spiral part of the sealing member 6 (13) (positioned toward direction D), with both the cut 25 and the spatial groove 28.

Figure 12:
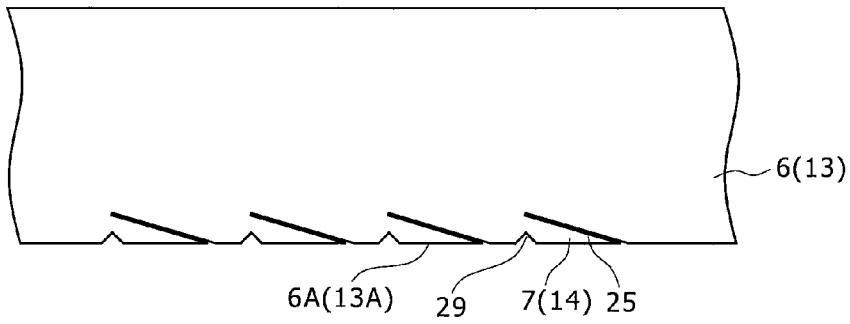
FIG. 12 is a diagram illustrating cuts and spatial grooves made in the sealing member according to a fourth example.

A fourth example will now be described. FIG. 12 shows the shapes of the lips 7 (14) of the sealing member 6 (13) according to the fourth example. In the description of the fourth example, elements identical with those of the first, second, or third example are designated by the same reference signs as the corresponding elements and will be omitted from the description. In the fourth example, a linear cut 25 is made with a spatial groove 29 formed in the lower side surface 6A (13A) of the sealing member 6 (13). The linear cut 25 is inclined at an angle (cosine angle) of smaller than 90 degrees from the bottom surface. The spatial groove 29 is disposed at a position corresponding to the base end 7A (14A) of the lips 7 (14). As the spatial grove 29 is formed, the rigidity of the base end 7A (14A) against the rise of the lips 7 (14) is lower than in the case of the lips 7 (14) according to the first example. Further, when the lips 7 (14) rise, the spatial grove 29 according to the fourth example ensures that the stress applied to the base end 7A (14A) of the lips 7 (14) is lower than in the case of the spatial groove 28 according to the third example. This makes it possible to prevent the base end 7A (14A) of the lips 7 (14) from being cracked.

The present example assumes that the spatial groove 29 is triangular in shape. However, the shape of the spatial groove 29 is not limited to triangular. For example, the spatial groove 29 may alternatively be shaped like an arc as far as it ensures that the base end 7A (14A) of the lips 7 (14) is thinner than when only the linear cut 25 is made for the lips 7 (14).

The rigidity of the base end 7A (14A) of the lips 7 (14) decreases with an increase in the size of the spatial groove 29. However, if the spatial groove 29 is excessively large in size, the lips 7 (14) may readily come off from the sealing member 6 (13) during processing, thereby making it difficult to achieve processing. Therefore, the size of the spatial groove 29 needs to be determined in consideration of the above.

Figure 15:
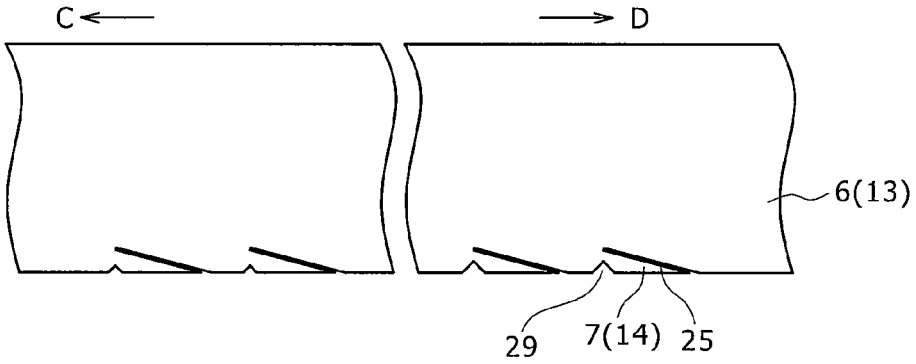
FIG. 15 is a diagram illustrating cuts and spatial grooves made in the sealing member according to a modification of the fourth example.

Referring to FIG. 12, the size of the spatial groove 29 for the first lip 7 (14), which is formed on the inward spiral part of the sealing member 6 (13), is equal to the size of the spatial groove 29 for the second lip 7 (14), which is displaced outward from the first lip 7 (14) and formed on the outward spiral part of the sealing member 6 (13). Alternatively, however, the first and second lips 7 (14) may differ in the size of the spatial groove 29. For example, as shown in FIG. 15, the size of the spatial groove 29 for the first lip 7 (14), which is formed on the inward spiral part of the sealing member 6 (13) (positioned toward direction D), may be larger than the size of the spatial groove 29 for the second lip 7 (14), which is formed on the outward spiral part of the sealing member 6 (13) (positioned toward direction C). When the size of the spatial groove 29 is increased for the inward spiral part (positioned toward direction D), where the sealing member 6 (13) significantly wears, the thickness of the base end 7A (14A) of the lips 7 (14) decreases. Consequently, the lips 7 (14) rise high even when the sealing member 6 (13) is worn. This will increase the useful life of the sealing member 6 (13).

Further, the first lip 7 (14), which is formed on the inward spiral part of the sealing member 6 (13) (positioned toward direction D), and the second lip 7 (14), which is formed on the outward spiral part of the sealing member 6 (13) (positioned toward direction C), may differ not only in the size of the spatial groove 29 but also in the angle (cosine angle) between the bottom surface and the cut 25. For example, the angle (cosine angle) between the bottom surface and the cut 25 for the second lip 7 (14), which is formed on the outward spiral part of the sealing member 6 (13) (positioned toward direction C), may be set to be smaller than the angle (cosine angle) between the bottom surface and the cut 25 for the first lip 7 (14), which is formed on the inward spiral part of the sealing member 6 (13) (positioned toward direction D). When the angle (cosine angle) between the bottom surface and the cut 25 for the second lip 7 (14), which is formed on the outward spiral part of the sealing member 6 (13), is decreased as described above, the thickness of the leading end 7B (14B) of the lips 7 (14) decreases. This enables the lips 7 (14) to rise even when the applied pressure is low. Consequently, the airtightness of the sealing member 6 (13) improves.

Meanwhile, the angle (cosine angle) between the bottom surface and the cut 25 for the first lip 7 (14), which is formed on the inward spiral part of the sealing member 6 (13) (positioned toward direction D), is larger than the angle (cosine angle) between the bottom surface and the cut 25 for the second lip 7 (14), which is formed on the outward spiral part of the sealing member 6 (13) (positioned toward direction C). This increases the rigidity of the base end 7A (14A) of the lips 7 (14). In this respect, increasing the size of the spatial groove 29 for the first lip 7 (14), which is formed on the inward spiral part of the sealing member 6 (13), makes it possible to reduce the rigidity of the base end 7A of the lips 7 (14) by decreasing the thickness of the base end 7A (14A). This poses no problem because the lips 7 (14) can rise high even when the sealing member 6 (13) is worn.

The spatial groove 29 need not always be formed for all lips 7 (14). It may alternatively be formed for some of the lips 7 (14) in order to provide increased ease of processing. For example, an alternative is to form the spatial groove 29 for the first lip 7 (14), which wears significantly and is formed on the inward spiral part of the sealing member 6 (13) (positioned toward direction D), as described in connection with the present example, and form no spatial groove 29 for the second lip 7 (14), which does not wear significantly and is formed on the outward spiral part of the sealing member 6 (13) (positioned toward direction C). More specifically, the second lip 7 (14), which is disposed on the outward spiral part of the sealing member 6 (13), may be formed merely by making the cut 25 while providing the first lip 7 (14), which is formed on the inward spiral part of the sealing member 6 (13), with both the cut 25 and the spatial groove 29.

Figure 17:
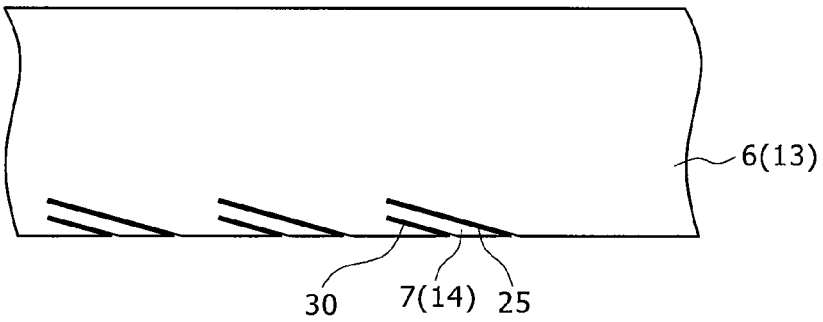
FIG. 17 is a diagram illustrating cuts made in the sealing member according to a fifth example.

A fifth example will now be described. FIG. 17 shows the shapes of the lips 7 (14) of the sealing member 6 (13) according to the fifth example. In the description of the fifth example, elements identical with those of the first, second, third, or fourth example are designated by the same reference signs as the corresponding elements and will be omitted from the description. In the fifth example, a linear cut 25 and a linear cut 30 are made. The linear cut 25 is inclined at an angle (cosine angle) of smaller than 90 degrees from the bottom surface. The linear cut 30 is made from the bottom surface and positioned between the base end 7A (14A) and leading end 7B (14B) of the lips 7 (14). The cut 30 is extended from the bottom surface of the sealing member 6 (13) toward the base end 7A (14A) of the lips 7 (14), substantially parallel to the cut 25, and inclined at an angle smaller than 90 degrees from the bottom surface. As the cut 30 is made in addition to the cut 25, the base end 7A (14A) is thinner than when the lips 7 (14) are formed by making the cut 25 only. Here, it is necessary to consider the fact that the rigidity of the base end 7A (14A) of the lips 7 (14) varies with the positional relationships between the lines of intersections of the bottom surface of the sealing member 6 (13) and the base end 7A (14A), leading end 7B (14B), and cut 30 of the lips 7 (14). More specifically, it is preferred that the cut 30 be positioned so as to reduce the rigidity of the base end 7A (14A) of the lips 7 (14). Therefore, in accordance with the results of analyses, the present example assumes that the distance between the leading end 7B (14B) of the lips 7 (14) and the line of intersection of the cut 30 and bottom surface is one-third to two-thirds the distance between the base end 7A (14A) and leading end 7B (14B) of the lips 7 (14).

A process for forming the lips 7 (14) according to the present example will now be described. As is the case with the lip formation process described with reference to FIGS. 7 and 8, which depict the first example, the lip formation process according to the present example makes plural cuts 30 in the ring-shaped sealing body 20, which is used as a material for the sealing member 6 (13), then moves the sealing body 20 to a position at which deeper cuts can be made without repositioning a cutter 23, and makes plural cuts 25 in such a manner that their positional relationship to the cuts 30 is as described earlier. Forming the cuts 25 and cuts 30 as described above makes it possible to form the lips 7 (14) without repositioning the cutter 23 and by using a simplified processing machine that has a simple configuration and does not include a forward/backward movement or mounting mechanism for the cutter 23. Alternatively, the cuts 25 may be formed with the cutter 23 moved to a position at which deeper cuts can be made without repositioning the sealing body 20 after formation of the cuts 30. Further, the cuts 30 may alternatively be formed after formation of the cuts 25 although, in the present example, the cuts 25 are formed after formation of the cuts 30.

In the above-described process for forming the lips 7 (14), the cuts 25 and the cuts 30 are formed with one cutter. Alternatively, however, the cuts 25 and the cuts 30 may be formed with two cutters that are arranged in parallel to each other. This alternative makes it possible to simultaneously form the cuts 25 and 30 by performing one cutting operation, thereby providing increased ease of processing. Further, this alternative also prevents the positional relationship between the cuts 25 and the cuts 30 from changing from one lip 7 (14) to another.

Figures 19A, 19B, 19C:
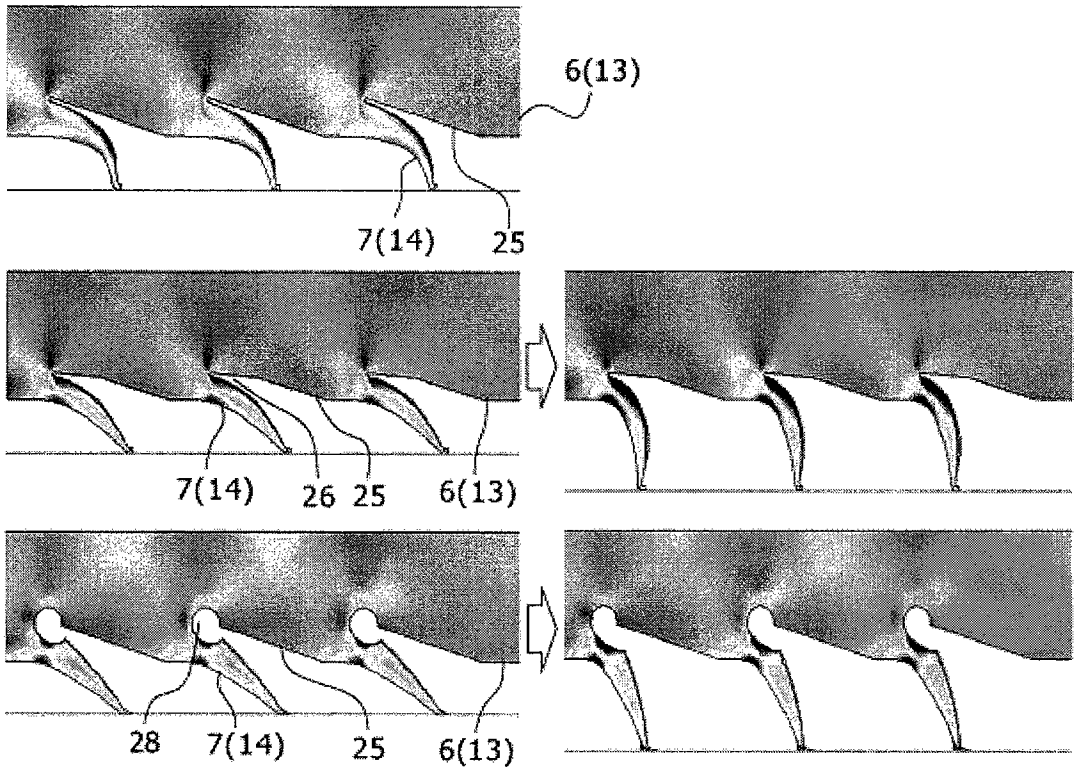
FIG. 19 shows the rise of the sealing member according to the first or third example.

Pictures in FIG. 19 illustrate how the lips 7 (14) rise when the compression chambers 17 apply a pressure to them. From FIG. 19A to 19C, the pictures respectively depict a case where the lips 7 (14) of the sealing member 6 (13) are formed by making linear cuts as described in JP-A No. 2004-92480 (see FIG. 19A), a case where the lips 7 (14) of the sealing member 6 (13) are formed by making two-step cuts as described in connection with the first example (see FIG. 19B), and a case where the lips 7 (14) of the sealing member 6 (13) are formed by making cuts and spatial grooves 28 as described in connection with the third example (See FIG. 19C).

As is obvious from FIGS. 19A-C, when the lips 7 (14) are formed as described in JP-A No. 2004-92480, the base end 7A (14A) of the lips 7 (14) has high rigidity so that the lips 7 (14) do not rise high even when a high pressure is applied from the compression chambers 17. When, on the other hand, the lips 7 (14) are formed as described in the first or third example, the base end 7A (14A) of the lips 7 (14) has low rigidity so that if a high pressure is applied from the compression chambers 17, the lips 7 (14) rise higher than when the lips 7 (14) are formed as described in JP-A No. 2004-92480. In the other examples, too, the lips 7 (14) rise higher than when the lips 7 (14) are formed as described in JP-A No. 2004-92480.

While the foregoing has described what are considered to be the best mode and/or other examples, it is understood that various modifications may be made therein and that the subject matter disclosed herein may be implemented in various forms and examples, and that the teaching may be applied in numerous applications, only some of which have been described herein. The present teachings may also be embodied by combining the first to fifth examples. It is intended by the following claims to claim any and all applications, modifications and variations that fall within the true scope of the present teachings.

What is claimed is:

1. A scroll fluid machine comprising:

a first scroll which includes a first end plate and a first wrap that is spirally wound onto the first end plate;

a second scroll which faces the first scroll and includes a second end plate and a second wrap that is spirally wound onto the second end plate in such a manner as to overlap with the first wrap of the first scroll and form plural compression chambers;

a recessed groove extending along a tooth area of one of the first wrap and the second wrap of the first scroll and the second scroll;

a sealing member mounted between the recessed groove and a tooth land of the other one of the first scroll and the second scroll; and a plurality of linear cut arrangements formed in the sealing member and generally equally spaced apart one-to-another along a direction of length along the sealing member, each arrangement forming a lip including:

a first linear cut extending from a surface of the sealing member at a first location on said surface and into the sealing member in a direction away from said first location at a first inclination angle so as to form a first side of the lip, and a second linear cut extending from said surface of the sealing member at a second location on said surface and into the sealing member in a direction away from said second location at a second inclination angle so as to form a second side of the lip, wherein said first location is spaced apart from the second location on the surface along the direction of length such that the first linear cut and the second linear cut, respectfully, do not intersect within the sealing member, wherein said second location is positioned between a leading end of the lip and a base end of the lip, wherein the leading end of the lip is adjacent to the surface of the sealing member, and the base end of the lip is adjacent to a third location at which the first linear cut and the second linear cut terminate in the sealing member, and wherein a distance between the first location and the second location of each arrangement of the plurality of arrangements along the direction of length of the sealing member is less than a distance between one of the first linear cut and the second linear cut in each arrangement and the other one of the first linear cut and the second linear cut in an adjacent arrangement in the plurality of arrangements along the direction of length of the sealing member.

2. The scroll fluid machine according to claim 1, wherein the first linear cut is substantially parallel to the second linear cut.

3. The scroll fluid machine according to claim 1, wherein the first inclination angle and the second inclination angle are inclined at an angle less than 90 degrees.

4. The scroll fluid machine according to claim 3, wherein the first inclination angle and the second inclination angle have substantially the same angular measure.

5. The scroll fluid machine according to claim 1, wherein a rigidity of the lip at the surface of the sealing member is less than a rigidity of the lip at the direction away from the first and the second location.

6. A scroll fluid machine comprising:

a first scroll which includes a first end plate and a first wrap that is spirally wound onto the first end plate;

a second scroll which faces the first scroll and includes a second wrap that is spirally wound;

a sealing member mounted between the first wrap of the first scroll and a land of the second scroll;

a plurality of linear cut arrangements formed in the sealing member and generally equally spaced apart one-to-another along a direction of length along the sealing member, each arrangement forming a lip including:

a first linear cut extending from a surface of the sealing member at a first location on said surface and into the sealing member in a direction away from said first location at a first inclination angle so as to form a first side of the lip, and a second linear cut extending from said surface of the sealing member at a second location on said surface and into the sealing member in a direction away from said second location at a second inclination angle so as to form a second side of the lip, wherein said first location is spaced apart from the second location on the surface along the direction of length such that the first linear cut and the second linear cut, respectfully, do not intersect within the sealing member, wherein said second location is positioned between a leading end of the lip and a base end of the lip, wherein the leading end of the lip is adjacent to the surface of the sealing member, and the base end of the lip is adjacent to a third location at which the first linear cut and the second linear cut terminate in the sealing member, and wherein a distance between the first location and the second location of each arrangement of the plurality of arrangements along the direction of length of the sealing member is less than a distance between one of the first linear cut and the second linear cut in each arrangement and the other one of the first linear cut and the second linear cut in an adjacent arrangement in the plurality of arrangements along the direction of length of the sealing member.

7. The scroll fluid machine according to claim 6, wherein the first linear cut is substantially parallel to the second linear cut.

8. The scroll fluid machine according to claim 6, wherein the first inclination angle and the second inclination angle are inclined at an angle less than 90 degrees.

9. The scroll fluid machine according to claim 8, wherein the first inclination angle and the second inclination angle have substantially the same angular measure.

10. The scroll fluid machine according to claim 6, wherein a rigidity of the lip at the surface of the sealing member is less than a rigidity of the lip at the direction away from the first location and the second location.

* * * * *